US006249211B1

(12) United States Patent
Hofsaess

(10) Patent No.: US 6,249,211 B1
(45) Date of Patent: Jun. 19, 2001

(54) TEMPERATURE-DEPENDENT SWITCH HAVING A CURRENT TRANSFER MEMBER

(76) Inventor: Marcel Hofsaess, Höfener Strasse 29, 75305 Neuenbürg (DE)

( * ) Notice: Subject to any disclaimer, the term of this patent is extended or adjusted under 35 U.S.C. 154(b) by 0 days.

(21) Appl. No.: 09/332,707

(22) Filed: Jun. 14, 1999

(30) Foreign Application Priority Data

Jun. 18, 1998 (DE) ..... 198 27 113

(51) Int. Cl.[7] ..... H01H 37/14; H01H 37/54

(52) U.S. Cl. ..... 337/377; 337/333; 337/343; 337/53; 337/77

(58) Field of Search ..... 337/102, 103, 337/104, 16, 36, 97, 298, 333, 343, 377, 390, 53, 77, 100; 29/622

(56) References Cited

U.S. PATENT DOCUMENTS

| | | | | |
|---|---|---|---|---|
| 2,753,421 | * | 7/1956 | Mertler | 337/347 |
| 3,265,839 | * | 8/1966 | Johnson | 337/91 |
| 3,496,511 | * | 2/1970 | Colavecchio | 337/343 |
| 3,768,057 | * | 10/1973 | Sekira et al. | 337/349 |
| 4,059,817 | * | 11/1977 | Hollweck et al. | 337/365 |
| 4,201,967 | * | 5/1980 | Romerdahl et al. | 337/354 |
| 4,555,686 | | 11/1985 | Pejouhy et al. . | |
| 4,862,132 | * | 8/1989 | Hollweck | 337/102 |
| 5,023,744 | * | 6/1991 | Hofsass | 361/26 |
| 5,043,690 | * | 8/1991 | Wahls | 337/370 |
| 5,309,131 | * | 5/1994 | Hofsass et al. | 337/102 |
| 5,615,072 | | 3/1997 | Hofsäss et al. . | |
| 5,721,525 | | 2/1998 | Hofsäss . | |
| 5,745,022 | * | 4/1998 | Becher et al. | 337/104 |
| 5,757,261 | * | 5/1998 | Becher et al. | 337/377 |
| 5,835,001 | | 11/1998 | Hofsäss . | |
| 5,892,429 | * | 4/1999 | Hofsass | 337/377 |
| 5,973,587 | * | 10/1999 | Hofsass | 337/377 |
| 6,031,447 | * | 2/2000 | Hofsass | 337/377 |

FOREIGN PATENT DOCUMENTS

| | | | | |
|---|---|---|---|---|
| 684664 | * | 11/1994 | (CZ) | H01H/37/54 |
| 2644411C2 | | 8/1984 | (DE) . | |
| 3701240A1 | | 8/1987 | (DE) . | |
| 3701240 | * | 11/1994 | (DE) | H01H/37/54 |
| 4428226C1 | | 10/1995 | (DE) . | |
| 19507105C1 | | 5/1996 | (DE) . | |
| 19545998C2 | | 5/1998 | (DE) . | |

* cited by examiner

*Primary Examiner*—Leo P. Picard
*Assistant Examiner*—Anatoly Vortman
(74) *Attorney, Agent, or Firm*—Harness, Dickey & Pierce, P.L.C.

(57) ABSTRACT

A temperature-dependent switch 10 has a temperature-dependent switching mechanism 11; a housing 12, receiving the switching mechanism 11 and having a lower part 14 and an upper part 15; and two stationary contacts 31, 32, provided on the upper part 15 on its inner side 37, each contact being connected to an associated external termina 35, 36. A current transfer member is arranged on the switching mechanism 11 and moved by it, which transfer member is in contact with the two stationary contacts 31, 32 in temperature-dependent fashion. There is arranged physically in the region of the current transfer member and upper part 15 at least one resistor 38 which is electrically connected between the stationary contacts 31, 32 at least when the current transfer member is in contact with them.

14 Claims, 2 Drawing Sheets

TEMPERATURE-DEPENDENT SWITCH HAVING A CURRENT TRANSFER MEMBER

Background of the Invention

1. Field of the Invention

The present invention relates to a temperature-dependent switch, having a temperature-dependent switching mechanism, a housing receiving the switching mechanism, which housing has a lower part and an upper part, two stationary contacts provided on the upper part on its inner side, each contact being connected to an associated external terminal, and a current transfer member, arranged on and moved by the switching mechanism, which current transfer member is in contact with the two stationary contacts in temperature-dependent fashion.

2. Related Prior Art

A switch of this kind is known from DE 26 44 411 C2.

The known switch has a housing with a cup-like lower part into which a temperature-dependent switching mechanism is placed. The lower part is closed off by an upper part which is held on the lower part by the latter's elevated rim. The lower part can be made of metal or of insulating material, while the upper part here is always made of insulating material.

Two rivets, whose inner heads act as stationary contacts for the switching mechanism, sit in the upper part. The switching mechanism carries a current transfer member in the form of a contact plate, which depending on the temperature is brought into contact with the two stationary contacts and then connects them electrically to one another.

The outer heads of the two rivets serve as solder terminals for leads.

The temperature-dependent switching mechanism has a bimetallic snap disk as well as a spring disk, which are penetrated centrally by a stem which carries the contact plate. The spring disk is guided peripherally in the housing, while the bimetallic snap disk is braced, depending on temperature, against the bottom of the lower part or on the rim of the spring disk, and thereby either allows the contact plate to rest against the two stationary contacts or lifts the contact plate away from the stationary contacts so that the electrical connection between the external terminals is interrupted.

This temperature-dependent switch is used in known fashion to protect electrical devices from overheating. For this purpose, the switch is connected electrically in series with the device to be protected, and is arranged mechanically on the device so that it is in thermal contact with it. Below the response temperature of the bimetallic snap disk, the contact plate rests against the two stationary contacts so that the circuit is closed and the device being protected receives power. If the temperature rises above a permissible value, the bimetallic snap disk lifts the contact plate away from the stationary contacts, thereby opening the switch and interrupting the supply of power to the device being protected so that the latter can cool off again, whereupon the switch automatically closes again.

Because of the dimensioning of the contact plate, the known switch is capable of carrying very much greater operating currents as compared with other temperature-dependent switches in which the operating current of the device being protected flows directly through the bimetallic snap disk or a spring disk associated with it, so that the known switch can be used to protect larger electrical devices with greater power consumption. Although the known switch meets many technical requirements, it nevertheless still exhibits disadvantages in certain applications.

One such disadvantage lies in the fact that after cooling, it automatically switches on again. While a switching behavior of this kind may be entirely suitable for protecting, for example, a hair dryer, such is not the case with many applications, specifically those in which the device being protected must not automatically switch back on in order to prevent damage. This applies, for example, to electric motors which are used as drive accessories.

In this connection, it is already known from DE 37 01 240 to equip a switch, having a contact bridge for connecting the two fixed contacts, with a self-hold function. In this switch a resistor is connected electrically in parallel with the two fixed contacts and carries a residual current when the switch is open, thereby heating up sufficiently such that it holds the bimetallic snap disk above its switching temperature. A disadvantage with the known switch, however, is the fact that the resistor and the bimetallic snap disk are housed in different chambers of an insulating housing, so that a separate metal bottom must be provided for heat transfer from the resistor to the bimetallic snap disk. A further disadvantage lies in the fact that the contact bridge is pressed against the fixed contacts by a helical compression spring, whose force must be continuously overcome by the bimetallic snap disk in the open state. The result of this heavy load on the bimetallic snap disk in the open state is that its switching temperature shifts unpredictably, so that both the response behavior and the self-hold function are unreliable and not reproducible.

The known switch can moreover also be equipped with a current-dependent switching function, for which purpose a further resistor is provided which is connected permanently in series with the external terminals. The operating current of the device being protected thus flows continuously through this heating resistor, which can be dimensioned so that when a specific operating current is exceeded, it causes the bimetallic snap disk to be heated to a level above its response temperature, so that in the event of an elevated operating current the switch opens even before the device being protected has heated up impermissibly. This function is also not implemented reliably in the known switch, however, since the heating resistor is arranged at an even greater physical distance from the bimetallic snap disk than the resistor for the self-hold function.

A further disadvantage of the known switch may be seen in its complex design configuration: specifically, the bimetallic snap disk actuates a switching pin which projects through the resistor for the self-hold function into a second chamber of the housing, where the contact bridge is attached to the switching pin. On the side remote from the bimetallic snap disk, there sits on the switching pin a helical compression spring which is braced at the other end internally against the housing. Fixed contacts, against which the contact bridge is pressed by the helical compression spring, project laterally into this second chamber of the known switch. The contacts in turn are pressed by projections of the plastic housing onto the resistor for the self-hold function.

With the known switch it is not apparent how production tolerances can be compensated for; assembly also appears to be extremely complex, and is probably feasible only by hand.

In addition to these "mechanical" disadvantages, however, the greatest disadvantage of the known switch lies in the poor thermal coupling between the resistors and the bimetallic snap disk.

Much better coupling between a resistor and a bimetallic snap disk is known from DE 37 10 672 C2, albeit for a switching mechanism wherein the operating current is directed through a spring disk associated with the bimetallic snap disk, meaning that the current may have much lower values than in the case of the generic switch. A two-part housing is present also in the case of the switch known from DE 37 10 672 C2, although in this case only one fixed countercontact is provided on the inner side of the cover, coacting with a movable contact that is carried by the spring disk which presses this contact against the fixed countercontact. Arranged above the spring disk is a bimetallic snap disk which, when its response temperature is exceeded, lifts the movable contact away from the fixed countercontact. In the closed state, operating current flows from the fixed countercontact into the movable contact, and from there through the spring disk into the electrically conductive lower part of the switch. In this known switch, there is arranged on the inner side of the cover a film resistor which is connected at one end to the fixed countercontact and at the other end to the electrically conductive lower part of the housing, so that when the switch is open the resistor carries a residual current, heats up as a result thereof, and holds the bimetallic snap disk at a high enough temperature so that the switch does not close again.

SUMMARY OF THE INVENTION

Proceeding from this prior art, it is an object of the present invention to improve the switch mentioned at the outset, with little design complexity, so as to open up further possible applications for it.

According to the present invention, this object is achieved with the switch mentioned at the outset by the fact that there is arranged physically in the region of the current transfer member and upper part at least one resistor which is electrically connected between the stationary contacts at least when the current transfer member is in contact with them.

The object underlying the invention is entirely achieved in this fashion. Specifically, the inventor of the present Application has recognized that it is also possible in the case of the generic switch to arrange a resistor in the immediate vicinity of the switching mechanism so as thereby to improve the thermal coupling between the bimetallic snap disk and the heat generated by that resistor in such a way as to achieve reproducible and rapid response behavior for current-dependent switching, and reliable holding behavior for the self-hold function. For the self-hold function, this can be done by providing the resistor on the upper part or configuring the upper part itself as a resistor, as is the case, for example, with a PTC cover. If, on the other hand, the intention is additionally or alternatively to achieve current-dependent switching, the resistor can be provided on the current transfer member, so that it is connected in series between the fixed contacts only when the switch, in the closed state, is carrying the operating current of the device being protected. The resistor provided on the current transfer member, which can be a contact plate, is located in the immediate vicinity of the bimetallic snap disk, so that a response time accurate to the second can be attained thanks to the good thermal coupling. In other words, by selecting the resistance value it is possible to define reproducibly the current level at which, and the time period after which, the new switch reliably opens. If the resistor is additionally provided on the upper part, the new switch also reliably remains open; because of the very good thermal coupling, even small residual operating currents are sufficient here to generate the necessary heat.

In an embodiment, at least one resistor is therefore arranged on the inner side of the upper part and is connected electrically between the two stationary contacts, while additionally or alternatively at least one resistor is arranged on the current transfer member and is connected electrically between two contact surfaces associated with the stationary contacts.

A further advantage with the new switch may be seen in the low level of design complexity with which one or both of the safety functions now achievable can be implemented. The generic switch could already be produced in simple and automated fashion; now, all that is necessary is to use in the production process a current transfer member modified according to the present invention, and/or an upper part equipped in accordance with the invention with a resistor, while all the other parts of the new switch correspond to those of the generic switch. In other words, only two further components need to be made available on the production line, so that four different switches can now be implemented selectably in, so to speak, modular fashion: the generic switch, a switch with a self-hold function, one with current-dependent switching, or indeed one with both safety functions.

It is immediately apparent that the conceptualization and design costs for the new switch are thus very low, and production costs can also be set at a very low level, since the generic switch has already been in series production for some time.

It is preferred, in a manner known per se, if the switching mechanism comprises a bimetallic snap disk which is mechanically joined to the current transfer member and below its switching temperature presses the latter against the stationary contacts, and above its switching temperature lifts it off from them, the switching mechanism also preferably comprising a spring disk which works against a bimetallic snap disk and preloads the current transfer member so as to press it against the stationary contacts; and the bimetallic snap disk, above its switching temperature, lifting the current transfer member away from the stationary contacts; the spring disk also preferably being arranged between current transfer member and bimetallic snap disk.

While it is entirely sufficient if only one bimetallic snap disk is provided, which both creates the contact pressure and causes temperature-dependent opening, by providing a spring disk which, alone or in addition to the bimetallic snap disk, effects the contact pressure, it is possible to relieve the mechanical load on the bimetallic snap disk in its low-temperature position, which contributes to greater long-term stability in its switching behavior.

It is further preferred if the current transfer member is an approximately round contact plate which is centrally joined by a stem-like rivet to the bimetallic snap disk.

This feature is also known per se, and it also ensures that the bimetallic snap disk is subject to very little mechanical load and thus exhibits good long-term stability in its switching behavior.

It is preferred in general if two connecting paths are provided on the inner side of the upper part, each connected at one end to the resistor and at the other end to one of the two stationary contacts; preferably the upper part is also penetrated by two rivets, whose inner heads serve as stationary contacts and whose outer heads serve as external terminals; preferably the resistor is also selected from the group comprising heating wire, heating film, film resistor, or PTC resistor.

All these features are advantageous in terms of design, since the various resistors can thus easily be placed between the contact surfaces or connecting surfaces; heating wires or heating films can be soldered or adhesively bonded on, while film resistors or PTC resistors, i.e. resistors with a positive temperature coefficient, can be applied by printing, sputtering, vacuum evaporation, etc. In other words, both the current transfer member and the upper part, with their connection capabilities for various resistors and resistance values, can be stockpiled as mass-production parts; they are then, based on the requirement of the particular application, equipped with different types of resistors and/or resistance values and channeled into the production line, so that a wide variety of switches can be produced in extremely simple fashion.

On the other hand, it is also preferred if the upper part itself is made from PTC material.

The advantage here is that no resistors at all need to be fitted; the upper part itself already exhibits the necessary resistor function, and overheating is, so to speak, automatically prevented by the characteristics of the PTC material. For the purposes of the present Application, an upper part made of PTC material is also "a resistor arranged physically in the region of the current transfer member and upper part," since arrangement of the resistor very close to the switching mechanism is achieved here as well. One great advantage of the PTC cover also lies in the fact that heat is radiated over the entire inner side into the interior of the switch, so that thermal coupling can be further improved.

Further advantages are evident from the description and the attached drawings.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

An embodiment of the invention is shown in the attached drawings and will be explained in more detail in the description below. In the drawings.

DETAILED DESCRIPTION OF A PREFERRED EMBODIMENT

Figure 1:
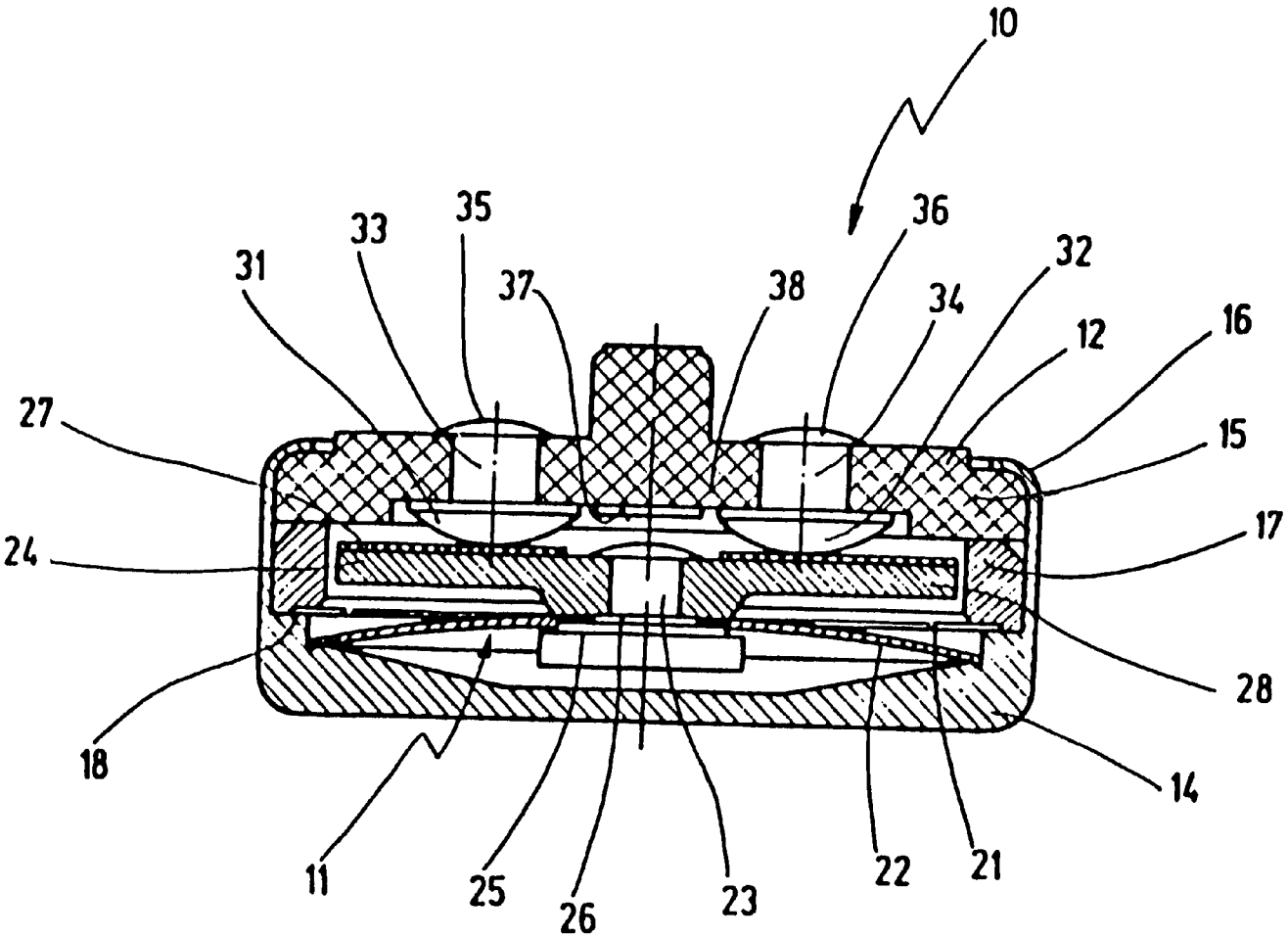
FIG. 1 shows a longitudinal section through the new switch.

In FIG. 1, 10 designates a temperature-dependent switch which comprises a temperature-dependent switching mechanism 11 that is housed in a housing 12.

Housing 12 comprises a lower part 14 and an upper part 15, closing off said lower part, which upper part is held on the latter by a flanged-over rim 16 of lower part 14. Arranged between lower part 14 and upper part 15 is a ring 17 which is braced on a step 18 of lower part 14 and there guides a spring disk 21 of switching mechanism 11 at its rim.

Switching mechanism 11 also comprises, in addition to spring disk 21, a bimetallic snap disk 22 which, together with spring disk 21, is penetrated centrally by a stem-like rivet 23 by way of which they are mechanically joined to a current transfer member in the form of a contact plate 24. Rivet 23 has a first step 25 on which the bimetallic snap disk sits with radial and axial clearance, a second step 26 being provided on which spring disk 21 sits, also with radial and axial clearance.

The aforementioned contact plate 24 has, in the direction of upper part 15, two contact surfaces 27, 28 joined to one another, which coact with stationary contacts 31, 32 which are inner heads of rivets 33, 34, which pass through upper part 15 and with their outer heads form external terminals 35, 36.

In the switch position shown in FIG. 1, spring disk 21 and bimetallic snap disk 22 press contact plate 24 against stationary contacts 31 and 32, which are thus connected to one another via contact surfaces 27, 28; switch 10 is closed.

If the temperature of bimetallic snap disk 22 rises above its response temperature, it then snaps over from the convex shape shown into a concave shape, and thereby becomes braced with its rim in the region of ring 17 and pulls contact plate 24, against the force of spring disk 21, away from stationary contacts 31, 32; switch 10 is now open.

The switch described so far is known from DE 26 44 411 C2. If the temperature then decreases again, the known switch would snap back into the closed state shown in FIG. 1. According to the present invention, however, upper part 15 now has on its inner side 37 a self-hold resistor 38 which lies physically between contact plate 24 and upper part 15 and is connected electrically between stationary contacts 31, 32, as will now be described with reference to FIG. 2.

Figure 2:
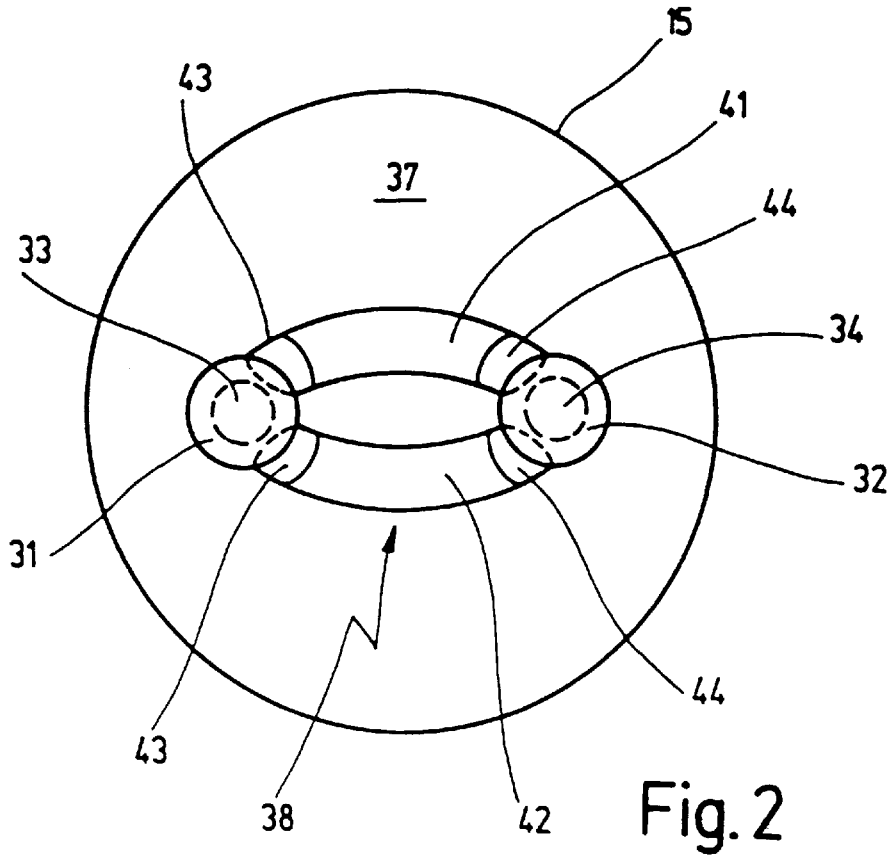
FIG. 2 shows a plan view of the inner side of the upper part of the switch shown in FIG. 1.

FIG. 2 is a plan view of inner side 37 of upper part 15, stationary contacts 31, 32 being shown and rivets 33, 34 being indicated.

Extending between stationary contacts 31, 32 are arc-shaped resistance paths 41, 42, which are connected at their ends to connecting surfaces 43 and 44, respectively, which pass under the inner heads of rivets 33, 34 and are correspondingly electrically connected to them.

Instead of resistance paths numerals 41, 42 can indicate heating wires, heating films, or other resistors that are connected to connecting surfaces 43, 44. Alternatively, it is also possible to produce upper part 15 entirely or partially from PTC material.

In any event, there is located directly above the current transfer member a self-hold resistor 38 which, when switch 10 is open, absorbs a residual operating current and thus heats it up sufficiently that bimetallic snap disk 22 is held at a temperature above its response temperature, so that the switch cannot close again.

Figure 3:
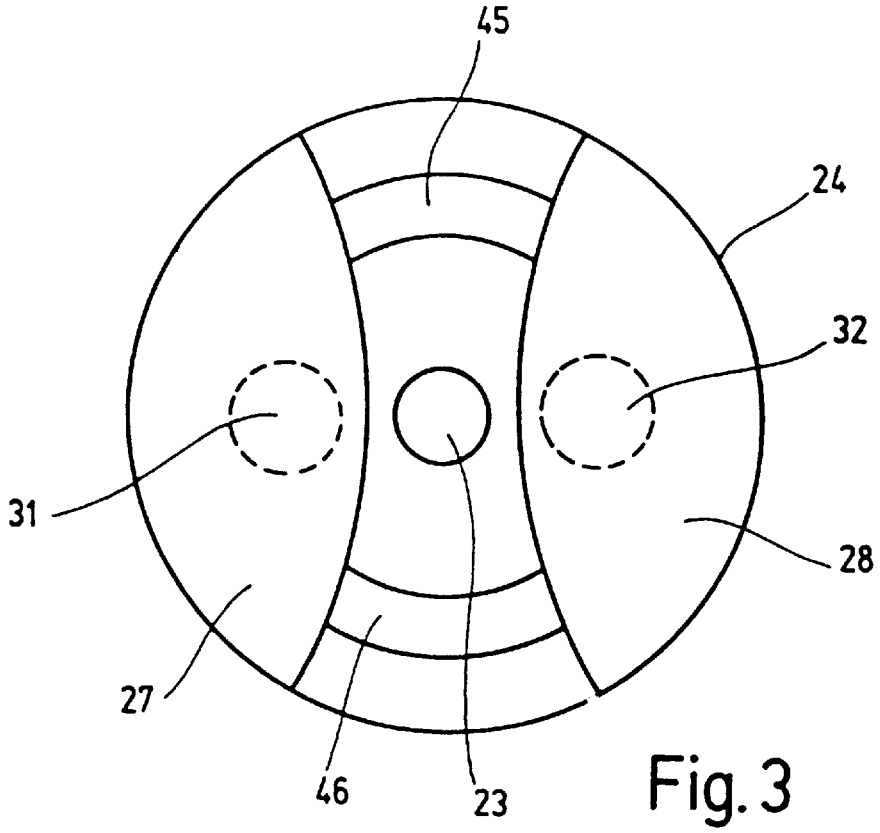
FIG. 3 shows a plan view of the current transfer member of the switch shown in FIG. 1.

In addition or alternatively to this so-called self-hold function, switch 10 can be equipped with a current-dependent opening function, for which purpose heating resistors 45, 46 are connected between contact surfaces 27, 28, as is evident from the plan view of contact plate 24 in FIG. 3. Contact surfaces 27, 28 come into contact with stationary contacts 31, 32 indicated with dashed lines in FIG. 3; the operating current flows from stationary contacts 31, 32 via contact surfaces 27, 28 and resistors 45, 46, which thus heat up as a result of this current flow. If the current level assumes a predefined value for a predefined time, heating resistors 45, 46 generate sufficient heat so that bimetallic snap disk 22 heats up above its response temperature. Since heating resistors 45, 46 are arranged directly on contact plate 24, particularly good thermal coupling is produced between heating resistors 45, 46 and bimetallic snap disk 22, so that a very accurate switching function can be set.

Heating resistors 45, 46 can also be arranged on the side of contact plate 24 facing toward bimetallic snap disk 22.

If the current-dependent switching function is not needed, either contact surfaces 27, 28 can be continuous with one another, or conductor paths which carry the operating current without appreciably heating up can be provided instead of heating resistors 45, 46.

Therefore, what I claim, is:

1. A temperature-dependent switch, comprising two external terminals;

a temperature-dependent switching mechanism;

a housing receiving the switching mechanism and comprising a lower part and an upper part, said upper part having an inner side;

two stationary contacts provided at the inner side of the upper part and being each connected to a respectively associated of said external terminals;

a current transfer member arranged on and moved by the switching mechanism in temperature-dependent fashion, said current transfer member being in contact with said two stationary contacts when the switch is in its closed state;

wherein at least one resistor is arranged on the current transfer member and is connected electrically between two contact surfaces associated with the stationary contacts, such that said at least one resistor in the closed state of the switch is electrically connected between the two stationary contacts.

2. The switch as in claim 1, wherein the switching mechanism comprises a bimetallic snap disk which is mechanically joined to the current transfer member and below its switching temperature presses the latter against the stationary contacts, and above its switching temperature lifts it off from the stationary contacts.

3. The switch as in claim 2, wherein the current transfer member is an approximately round contact plate which is centrally joined by a stem-like rivet to the bimetallic snap disk.

4. The switch as in claim 1, wherein the switching mechanism comprises a spring disk which works against a bimetallic snap disk and preloads the current transfer member so as to bring it against the stationary contacts; and the bimetallic snap disk, above its switching temperature, lifts the current transfer member away from the stationary contacts.

5. The switch as in claim 4, wherein the spring disk is arranged between current transfer member and bimetallic snap disk.

6. The switch as in claim 1, wherein the upper part is penetrated by two rivets, whose inner heads serve as stationary contacts and whose outer heads serve as external terminals.

7. The switch of claim 1, wherein the upper part is made from PTC material, such that a resistor is connected electrically between the two stationary contacts.

8. The switch as in claim 1, wherein the at least one resistor is selected from the group consisting of heating wire, heating film, film resistor, and PTC resistor.

9. The switch as in claim 1; wherein at least one further resistor is arranged on the inner side of the upper part and is connected electrically between the two stationary contact.

10. The switch as in claim 9, wherein the switching mechanism comprises a spring disk which works against a bimetallic snap disk and preloads the current transfer member so as to bring it against the stationary contacts; and the bimetallic snap disk, above its switching temperature, lifts the current transfer member away from the stationary contacts.

11. The switch as in claim 9, wherein the at least one resistor is selected from the group consisting of heating wire, heating film, film resistor, and PTC resistor.

12. The switch as in claim 9, wherein two connecting paths are provided on the inner side of the upper part, each connected at one end to the at least one further resistor and at the other end to one of the two stationary contacts.

13. The switch as in claim 9, wherein the switching mechanism comprises a bimetallic snap disk which is mechanically joined to the current transfer member and below its switching temperature presses the latter against the stationary contacts, and above its switching temperature lifts it off from the stationary contacts.

14. The switch as in claim 13, wherein the current transfer member is an approximately round contact plate which is centrally joined by a stem-like rivet to the bimetallic snap disk.

* * * * *